US005845820A

United States Patent [19]

Foster

[11] Patent Number: 5,845,820

[45] Date of Patent: Dec. 8, 1998

[54] BAYONET-TYPE CONTAINER AND CAP CLOSURE

[75] Inventor: Donald D. Foster, St. Charles, Mo.

[73] Assignee: Continental Sprayers International, Inc., St. Peters, Mo.

[21] Appl. No.: 918,069

[22] Filed: Aug. 25, 1997

[51] Int. Cl.[6] ..... B67D 5/40; B65D 55/02

[52] U.S. Cl. ..... 222/383.1; 215/222; 215/224

[58] Field of Search ..... 215/222, 224; 239/333; 222/383.1

[56] References Cited

U.S. PATENT DOCUMENTS

| | | | |
|---|---|---|---|
| 4,739,890 | 4/1988 | Cooke | 215/222 |
| 5,320,233 | 6/1994 | Welch | 215/252 |
| 5,431,291 | 7/1995 | LaBombarbe, Jr. | 215/44 |
| 5,533,633 | 7/1996 | King | 215/252 |

FOREIGN PATENT DOCUMENTS

| | | | |
|---|---|---|---|
| 0202380 | 11/1986 | European Pat. Off. | 239/333 |

*Primary Examiner*—Andres Kashnikow
*Assistant Examiner*—Keats Quinalty
*Attorney, Agent, or Firm*—Howell & Haferkamp, L.C.

[57] ABSTRACT

In a cap and container closure, the cap is integrally formed with a trigger sprayer housing and the cap and container have a bayonet-type closure that attaches the cap to the container by pressing the cap downwardly on the container without turning, or by no more than a quarter turn of the cap relative to the container, and the cap also has upper and lower lugs that engage against the top and bottom surfaces of ridges on the container neck to hold the cap securely on the container neck and prevent any rocking movement of the cap on the container.

20 Claims, 3 Drawing Sheets

BAYONET-TYPE CONTAINER AND CAP CLOSURE

BACKGROUND OF THE INVENTION (1) Field of the Invention

The present invention pertains to a closure for a cap and container. In particular, the present invention pertains to a cap and container where the cap is integrally formed with a trigger sprayer housing and the cap and container have a bayonet-type closure that attaches the cap to the container by pressing the cap downwardly on the container without turning, or by a quarter turn of the cap relative to the container, and where the cap also has upper and lower lugs that engage against the top and bottom surfaces of ridges on the container neck to hold the cap securely on the container neck and prevent any rocking movement of the cap on the container.

(2) Description of the Related Art

A trigger sprayer typically comprises a sprayer housing containing a pump chamber, a liquid supply passage communicating with the pump chamber, and a liquid discharge passage communicating with the pump chamber. A dip tube is connected to the liquid supply passage and is extended into the liquid of a container, such as a bottle, when the trigger sprayer is attached to the container to provide fluid communication between the liquid of the container and the trigger sprayer pump. A manually manipulated trigger is mounted on the sprayer housing for pivoting movement. A piston is received in the pump chamber for reciprocating movement and is operatively connected to the trigger, whereby the piston will reciprocate in the pump chamber in response to manual pivoting movement of the trigger. A nozzle is provided at the discharge end of the discharge passage for spraying liquid pumped into the pump chamber through the dip tube and supply passage, and then pumped out of the pump chamber through the discharge passage by the pivoting movement of the trigger.

Many prior art trigger sprayers were attached to their liquid containers by an internally threaded cap that is mounted to the sprayer housing to permit rotational movement of the cap relative to the housing. In order to firmly secure the trigger sprayer on the liquid container, the cap typically would be provided with a single spiraling thread in its interior surface that mated with a complimentary thread provided on the exterior of the container neck. Several revolutions of the cap relative to the trigger sprayer housing and the container were needed to securely attach the trigger sprayer to the container. This prior art method of attaching a trigger sprayer to a liquid container provided a secure closure between the trigger sprayer cap and the container neck that would hold the trigger sprayer stationary relative to the container in its adjusted position and prevent any rocking movement of the trigger sprayer relative to the container when the trigger of the sprayer is operated.

In the production of products contained in liquid containers that employ trigger sprayers of the above-described type in dispensing the products, trigger sprayers would be assembled onto liquid filled containers in a production line. The assembly of the trigger sprayers onto the liquid containers would often require two separate specially designed machines. The first machine would move the trigger sprayer downwardly toward the liquid filled container in a precise movement and insert the dip tube of the sprayer through the container opening while positioning the cap of the sprayer at the top of the container neck. The second machine would then rotate the cap several revolutions while the first machine held the trigger sprayer stationary in its desired orientation relative to the liquid container. Alternatively, an additional portion of the second machine would hold the trigger sprayer stationary while the cap is rotated. These two production steps required elaborately designed machines which at times would perform less than adequately, often making it necessary to manually tighten the trigger sprayer caps on the container necks to ensure they seal properly.

The complexities involved in assembling rotating cap trigger sprayers to the necks of liquid-filled containers resulted in the development of trigger sprayers having bayonet connectors. The basic difference of the bayonet connectors was that instead of employing a screw thread in the cap interior that required the cap to be rotated several times to attach the trigger sprayer to the liquid container neck, the bayonet connector could be moved downwardly onto the container neck and then turned less than one complete turn to securely snap-fit the bayonet connector on the container neck. For some bayonet connectors no rotary movement was necessary and the connector would snap onto the container neck at the end of its downward movement. As a result of the development of the bayonet connector, a single machine could be provided on the production line to move the trigger sprayer downwardly onto the container neck and then rotate the trigger sprayer a fraction of a complete turn to secure the trigger sprayer housing to the container neck.

However, several designs of bayonet connectors were disadvantage in that they did not provide the secure connection between the trigger sprayer and the liquid container provided by the engagement of complimentary screw threads of the trigger sprayer cap and container neck. Bayonet connectors would often permit the trigger sprayer to rock from side to side on the container neck when in use. As a result, trigger sprayers employing bayonet connectors were not seen as being desirable or comfortable to use by consumers as trigger sprayers employing a rotating cap closure.

The disadvantages of prior art trigger sprayers discussed above could be overcome by a closure for a cap and a container that enables the cap to be assembled onto the container neck without requiring the cap to be rotated several times in assembling it to the neck, yet still provides a secure connection between the cap and container neck that prevents rocking of the cap relative to the container.

SUMMARY OF THE INVENTION

The present invention provides a closure that may be employed on trigger sprayers, but may also be employed in any environment requiring a cap and container, where the cap is securely assembled to the container neck by either being snap-fit on the container neck or by rotating the cap less than one complete turn relative to the container neck, and where the closure provides a secure attachment between the cap and container neck that prevents rocking of the cap on the neck.

The closure of the present invention is provided on a cap and a liquid container. In the preferred embodiment, the cap is an integral, monolithic part of a trigger sprayer housing. However, the closure of the invention may be employed on a cap and container combination of any type and it is not necessary that the closure be limited to the cap of a trigger sprayer.

The cap of the closure includes a cylindrical skirt that depends downwardly as an integral extension of the trigger sprayer housing. The cap skirt has a cylindrical interior surface with a center axis. A number of lower lugs project radially inwardly from the interior surface of the cap. In the preferred embodiment there are four lower lugs on the cap interior surface. Pairs of upper lugs are positioned at an axial spacing above each of the lower lugs. The pairs of upper lugs also project radially inwardly from the cap interior surface. Each pair of upper lugs is positioned arcuately on opposite sides of its associated lower lug. As an alternative to the pairs of upper lugs, a single upper lug in the form of an annular rim could be provided projecting radially inwardly from the cap interior surface and spaced axially above the number of lower lugs. The lower lugs and their associated pairs of upper lugs are spacially arranged on the interior surface of the cap where the upper lugs are arranged in a circle in a single plane perpendicular to the cap center axis and the lower lugs are arranged in a circle in a separate, single plane perpendicular to the cap center axis. Arcuate spacings are provided between the adjacent pairs of upper lugs and between the adjacent lower lugs.

The container has a circular opening at its top and a cylindrical neck surrounding the opening. An annular shoulder surrounds the bottom of the neck and separates the container neck from the body of the container. An annular rim projects radially outwardly from the container neck and is spaced axially above the shoulder. Four arcuate ridges project radially outwardly from the surface of the container neck. Each of the ridges has a leading and a trailing end and an arcuate spacing is provided between the leading and trailing end of adjacent ridges. Each ridge has an axial width that corresponds to the axial spacing between the lower lugs and their associated pairs of upper lugs of the cap.

At least one stop is provided on the container neck. In the preferred embodiment of the invention, two stops are provided on the container neck. Each stop is formed as a wall extending radially outwardly from the container neck and extending axially over the container neck from the trailing end of one of the ridges to the annular rim. Alternatively, the stop wall could extend axially from the trailing end of one of the ridges in the opposite direction toward the top of the container neck. In the preferred embodiment, the two stops are positioned extending from the trailing ends of two adjacent ridges.

The cap may be attached to the container neck by two methods. In the first method, the cap and container neck are positioned in desired relative positions with the cap and container neck axes aligned and with the cap interior surface just above the opening of the container neck. Where the cap is part of a trigger sprayer the trigger sprayer and container are in their relative positions desired when the trigger sprayer is to be used in dispensing a product from the container. The cap is then moved axially, downwardly on the container neck causing the lower lugs to snap over the ridges. This positions each of the ridges on the container neck between a lower lug and a pair of upper lugs, thus securely holding the cap to the container neck and preventing any relative rocking of the cap on the container neck.

Alternatively, the cap is rotated slightly relative to the container neck from its position it will occupy when a trigger sprayer that is part of the cap would be used in dispensing a liquid product from the container. In this rotated position, the lower lugs and their associated pairs of upper lugs of the cap are positioned just above the arcuate spacings between adjacent ridges on the container neck. The cap is then moved downwardly onto the container neck with the lower lugs passing through the arcuate spacings between adjacent ridges. The cap is then rotated slightly relative to the container causing the ridges on the container neck to pass between the lower lugs and their associated pairs of upper lugs. The rotation is continued until two of the lower lugs of the cap engage against the stops of the container neck, thus preventing any further rotation and completing attachment of the cap on the container neck. Again, the engagement of the ridges between the lower and upper lugs securely holds the cap to the container and prevents any rocking movement of the cap on the container.

The closure of the invention described above provides a closure for a cap and container, where the cap may be securely attached to the container by snap-fitting the cap on the container or by turning the cap less than one-quarter of a turn relative to the container neck while providing a secure connection between the cap and container neck where the cap will not rock relative to the container.

BRIEF DESCRIPTION OF THE DRAWINGS

Further objects and features of the present invention are set forth in the detailed description of the preferred embodiments of the invention and in the drawing figures wherein.

DESCRIPTION OF THE PREFERRED EMBODIMENTS

Figure 1:
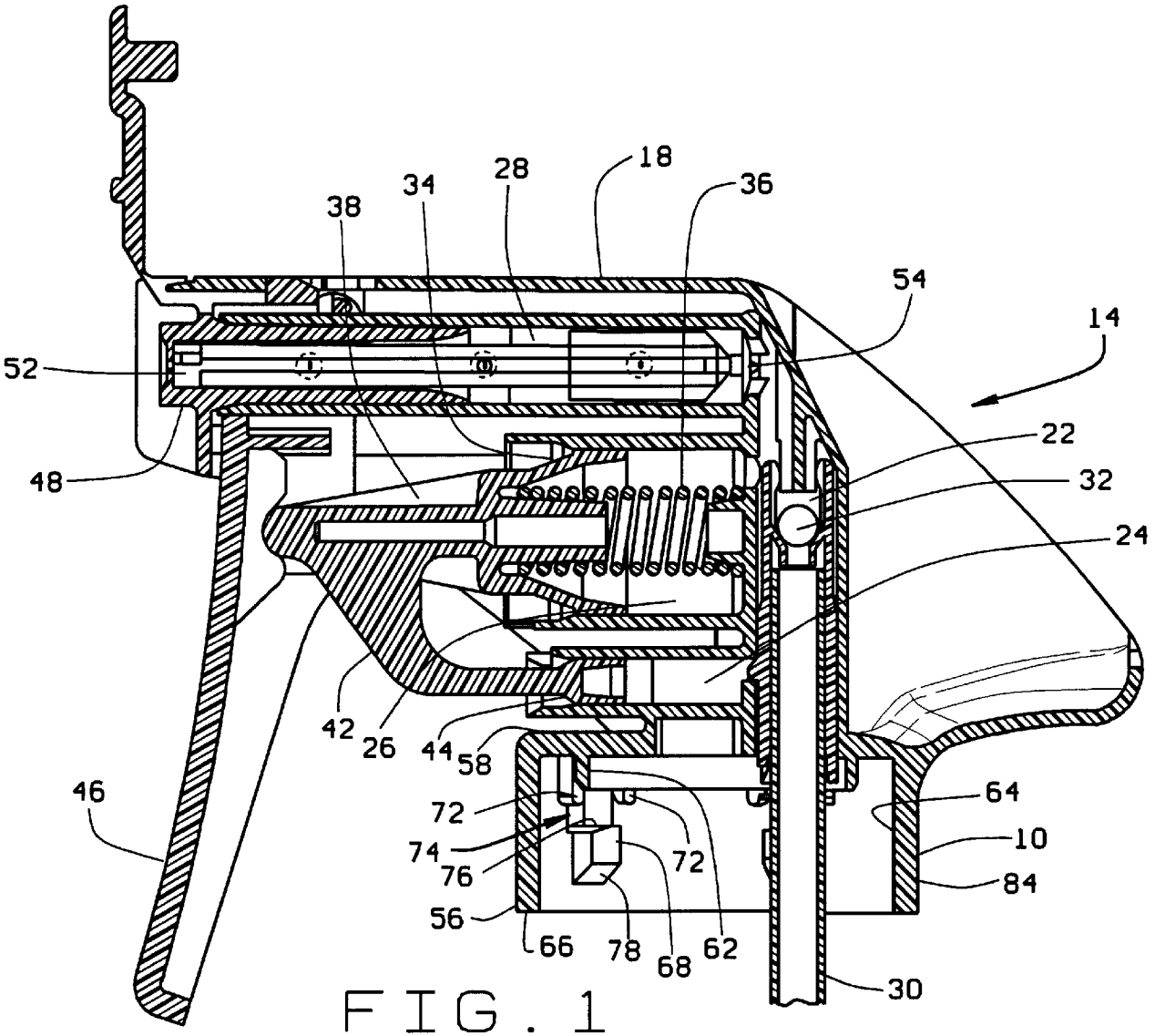
FIG. 1 is a side elevation view in section of a trigger sprayer employing the closure of the invention.
Figure 2:
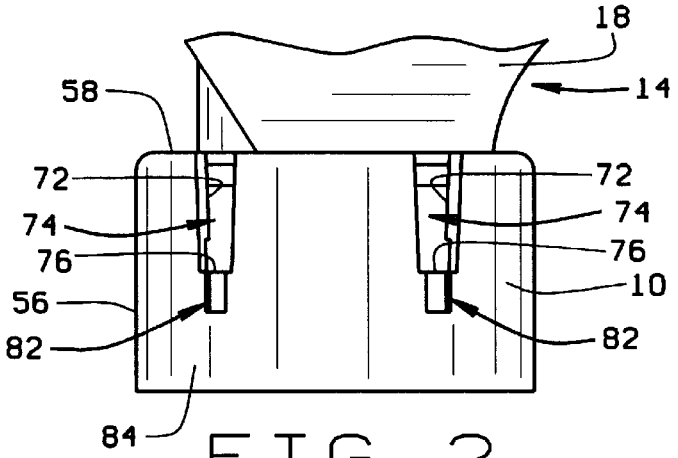
FIG. 2 is a partial elevation view of the exterior of a cap employing the closure of the invention.
Figure 5:
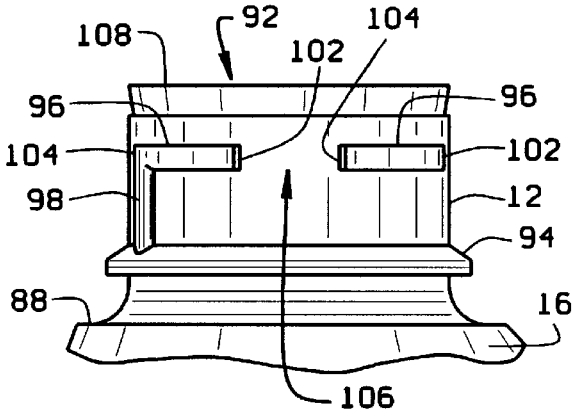
FIGS. 5–8 are left side, right side, front and back elevation views, respectively, of a container neck employing the closure of the invention.
Figure 6:
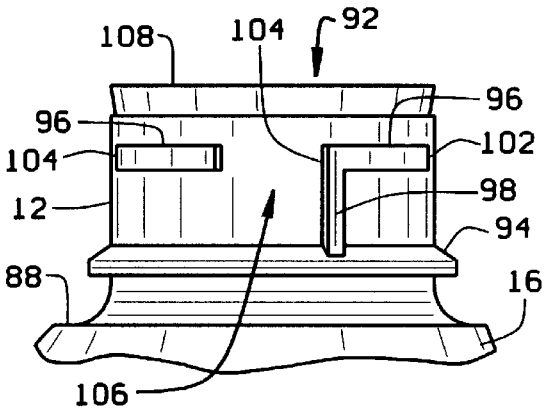
Figure 7:
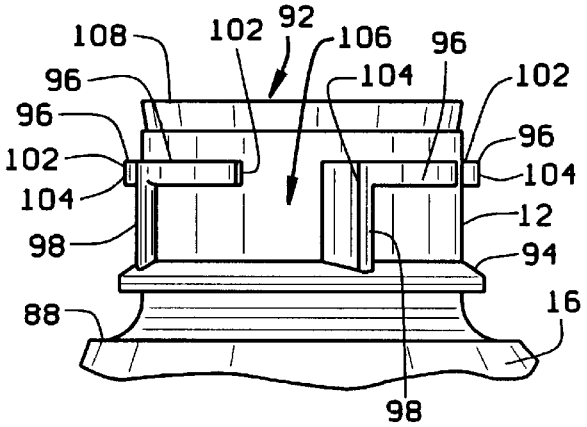
Figure 8:
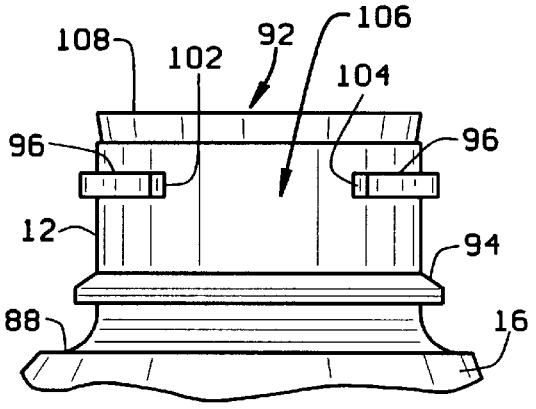
Figure 3:
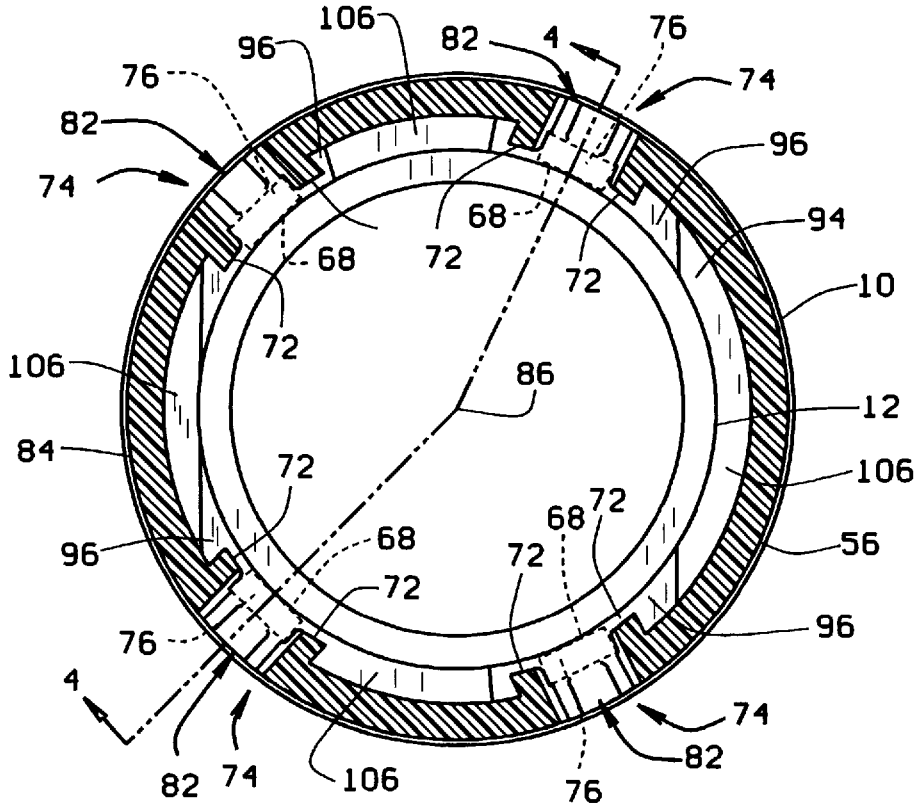
FIG. 3 is a top plan view in section showing the closure of the invention employed on a cap and container neck.
Figure 4:
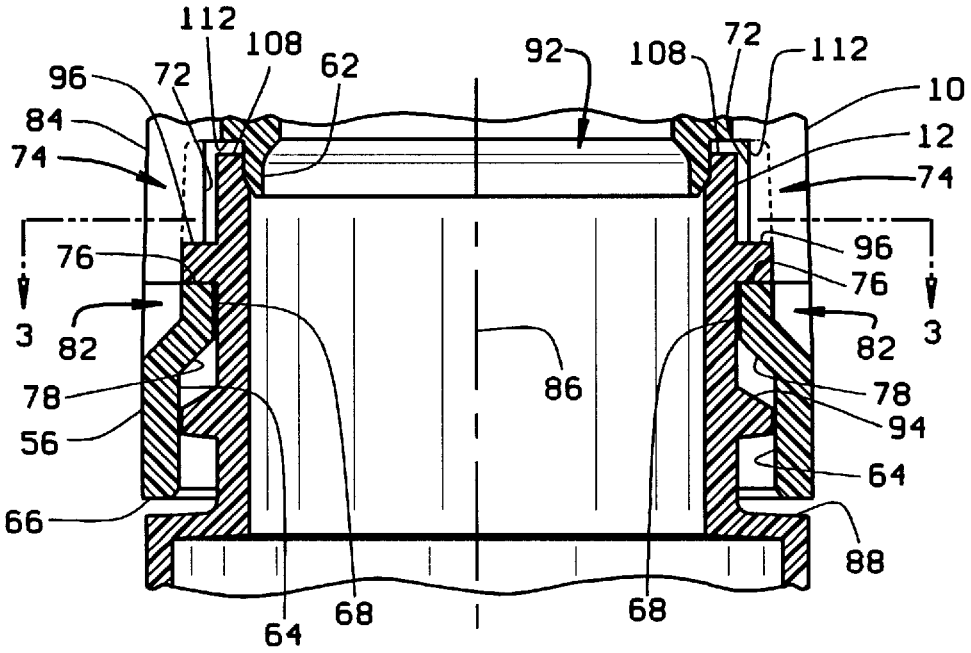
FIG. 4 is a partial elevation view in section showing the closure of the invention.

FIGS. 1–8 illustrate the use of a closure of the invention on a trigger sprayer housing and bottle container. It should be understood that this environment in which the closure of the invention is employed is illustrative only and that the closure of the invention may be employed in any other type of environment where it is desirable to seal close a bottle neck opening by a cap by snap-fitting the cap on the bottle neck or by only turning the cap a small amount on the bottle neck. The closure of the invention is basically comprised of a cap 10 and a bottle or container neck 12. FIG. 1 shows the cap 10 formed as an integral part of a trigger sprayer 14. FIGS. 3–8 show the bottle or container neck 12 provided on a bottle 16 intended to receive the trigger sprayer 14. FIGS. 3 and 4 show only the cap 10 and the bottle neck 12, with the trigger sprayer removed from the cap. It should be understood that where the cap 10 is employed with a trigger sprayer 14, the construction of the closure of the invention permits the cap to be formed integrally as one piece with the trigger sprayer 14, thereby reducing the component parts of the trigger sprayer and accordingly reducing its manufacturing costs.

The trigger sprayer 14 with which the cap 10 is employed may be any type of trigger sprayer and that shown in FIG. 1 is illustrative only and will therefore only be described in general terms. The trigger sprayer 14 includes a housing 18 that is comprised of a liquid supply passage 22, a vent chamber 24, a pump chamber 26, and a liquid discharge passage 28. The liquid supply passage 22, vent chamber 24, pump chamber 26, liquid discharge passage 28 and the cap 10 are all integrally molded with the trigger sprayer housing 18 as one monolithic piece. In other embodiments, the cap 10 may be attached to the trigger sprayer housing 18 for rotational movement relative thereto as is done in many prior art trigger sprayers.

A dip tube 30 is inserted into the lower end of the liquid supply passage 22 and extends into the interior of the bottle container 16 when the trigger sprayer 14 is attached to the bottle. The dip tube 30 supplies liquid to the liquid supply passage 22 which in turn communicates the liquid to the pump chamber 26 when the pump is actuated. A priming valve 32 controls liquid flow from the dip tube 30 to the pump chamber and prevents flow from the pump chamber 26 to the dip tube.

A pump piston 34 is received in the interior of the pump chamber 26 for reciprocating movement therein. A coil spring 36 biases the pump piston 34 to the left as viewed in FIG. 1 to the charge position of the pump piston 34 relative to the pump chamber 26. The pump piston 34 is moved against the bias of the spring 36 or to the right as viewed in FIG. 1 when moved to its discharge position forcing liquid from the pump chamber, as is conventional. A piston rod 38 extends forwardly from the pump piston 34. An arm 42 extends downwardly from the piston rod 38 and has a vent piston 44 attached at its distal end. The vent piston 44 reciprocates to the vent chamber 24 providing a path of airflow to vent the interior of the bottle container 16 when the pump piston 34 is moved to its discharge position in the pump chamber 26. A trigger 46 is mounted to the trigger sprayer housing 18 for oscillating, pivoting movement relative thereto. The trigger 46 engages with the piston rod 38 and, in response to manual oscillating movement of the trigger 46 on the trigger sprayer housing 18, the piston rod 38 causes the pump piston 34 and vent piston 44 to reciprocate in the pump chamber 26 and vent chamber 24, respectively.

A nozzle assembly 48 is inserted into a downstream end of the liquid discharge passage 28. The liquid discharge passage 28 also contains a liquid spinner 52 and a one-way check valve 54.

The above-described construction of the trigger sprayer 14 is for the most part conventional, although certain component parts may vary in different types of trigger sprayers. All of these trigger sprayers function in basically the same manner. When attached to a liquid filled container, the manual manipulation of the trigger 46 will cause reciprocation of the pump piston 34 in the pump chamber 26 and reciprocation of the vent piston 44 in the vent chamber 24. The reciprocation of the pump piston in the piston chamber first vents air in the pump chamber from the trigger sprayer then draws liquid from the bottle container through the dip tube 30 and the liquid supply passage 22 to the pump chamber 26. The draw of liquid into the pump chamber 26 is a result of a vacuum created in the pump chamber when the pump piston 34 moves from its discharge position toward its charged position in the pump chamber shown in FIG. 1. On subsequent movement of the trigger and pump piston where the pump piston moves from its charge position shown to its discharge position, the internal volume of the pump chamber is decreased and the liquid drawn into the pump chamber is pumped through the one way check valve 54, the liquid discharge passage 28 and the liquid spinner 52 before being discharged from the nozzle assembly 48.

The cap 10 that forms a part of the closure of the invention has a cylindrical skirt 56. A top wall 58 of the cap extends across the top of the skirt 56 and connects the cap integrally with the trigger sprayer housing 18. In the interior of the cap, an annular sealing collar 62 depends downwardly from the top wall 58 a short distance. The diameter of the collar 62 is dimensioned to fit tightly into the interior of the container neck as will be explained. Spaced radially outwardly from the cap collar 62, the interior surface 64 of the cap skirt 56 depends downwardly to a bottom annular edge 66 of the cap. The skirt interior surface 64 is generally cylindrical and smooth except for the presence of four separate lower lugs 68, four pairs of upper lugs 72 and apertures 74 through the skirt positioned between the upper lugs 72 of each pair. In the preferred embodiment of the invention, four lower lugs 68 and four pairs of upper lugs 72 are provided on the cap interior surface; however, the number of lugs could be varied in other embodiments of the closure.

As best seen in FIGS. 1 and 4, each of the lower lugs 68 has a top surface 76 and a bottom surface 78. The top surface 76 of each lower lug is slightly arched which facilitates its passing beneath ridges provided on the container neck when attaching the cap to the container neck as will be described. The lower lug bottom surface 78 tapers upwardly slightly as it extends radially inwardly from the skirt interior surface 64. The tapered configuration of the bottom surface 78 facilitates in the attachment of the cap on the container neck by snap fitting the lower lugs 68 over the ridges on the container neck as will be explained.

Positioned axially above each of the lower lugs 68 is one of the apertures 74 that pass through the cap skirt 56. The apertures 74 are a result of the molding process employed in forming the cap 10 and are not essential to the functioning of the closure of the invention. Therefore, the cap skirt 56 could be formed with the lower lugs 68 and upper lugs 72 to be described without the presence of the apertures 74 and the functioning of the closure of the invention would not be affected. Additionally, as seen in FIG. 2, small recesses 82 are formed in the exterior surface 84 of the cap skirt when molding the lower lugs 68. These also are a result of the molding process employed in forming the lower lugs 68 on the cap interior surface and are not essential for the proper functioning of the lower lugs and upper lugs.

Each pair of upper lugs 72 projects radially inwardly from the cap skirt interior surface 64 at arcuately spaced positions on opposite sides of the apertures 74 and at a small axial spacing above its associated lower lug 68. As best seen in FIG. 4, the pairs of upper lugs 72 do not project radially inwardly from the cap skirt interior surface 64 to the same extent as their associated lower lug 68. The pairs of upper lugs 72 are formed as a result of the particular molding process employed and each pair of upper lugs 72 could be replaced by a single upper lug at the same axial spacing above its associated lower lug 68. Alternatively, the upper lugs 72 could all be replaced by a single annular rim projecting radially inwardly from the cap skirt interior surface 64 at the same axial spacing above the lower lugs 68.

Referring to FIG. 3, it is seen that the lower lugs 68 are arcuately spaced from each other and their associated pairs of upper lugs 72 are arcuately spaced from the other pairs of upper lugs on the cap skirt interior surface 64, but the arcuate spacing between adjacent lower lugs and the arcuate spacing between their associated upper lugs is not the same. In other embodiments of the invention, the lower lugs and their associated upper lugs could all have the same arcuate spacing between them. The particular arcuate spacing between the lugs shown in the drawings is employed to coincide with the particular arcuate spacings of ridges on the container neck to be described. Therefore, if the cap of the closure of the invention is employed with a container neck of the closure of the invention where the neck ridges have an equal arcuate spacing between them, then the arcuate spacing between the lower lugs and the arcuate spacing between their associated upper lugs would also be equal to match that of the container ridges.

As best seen in FIGS. 1 and 4, the lower lugs 68 are arranged on the cap skirt interior surface 64 in a single plane that is perpendicular to the cap center axis 86 and the pairs of upper lugs 72 are arranged on the cap skirt interior surface 64 in a second, single plane perpendicular to the cap center axis 86.

The bottle 16 has an annular shoulder 88 at its top and the cylindrical neck 12 of the bottle extends upwardly from the shoulder to the bottle neck opening 92. An annular rim 94 extends radially outwardly from the bottle neck 12 slightly above the bottle shoulder 88. The rim 94 is provided to stabilize the cap 10 on the neck 12 as will be explained. The exterior surface of the bottle neck 12 above the annular rim 94 is cylindrical and smooth except for the presence of four separate arcuate ridges 96 and two axial stops 98. In the preferred embodiment of the closure, four arcuate ridges 96 are provided to correspond to the number of lower lugs 68 and pairs of upper lugs 72 on the cap. In other embodiments of the invention the number of ridges may be varied. Each of the ridges 96 project radially outwardly from the bottle neck exterior surface to the same extent as the annular rim 94. Each of the ridges has a leading end 102 and a trailing end 104 and an arcuate length therebetween. An arcuate spacing is provided between the leading end 102 of a ridge and the trailing end 104 of its next adjacent ridge. The arcuate spacing 106 between adjacent ridges 96 is sufficiently large to enable the lower lugs 68 of the cap to pass therethrough when attaching the cap to the container neck 12 as will be explained. Each of the ridges 96 also has a axial width that corresponds to the axial spacing between the lower lugs 68 and their associated pairs of upper lugs 72.

In the preferred embodiment, two stops 98 are provided on the neck 12, although one stop could be employed or more than two stops could be employed in other embodiments of the closure. Each stop 98 is formed as a wall that projects axially outwardly from the neck 12 to the same extent as the ridges 96. The stops 98 extend axially over the container neck 12 from the trailing ends 104 of two of the ridges 96 to the annular rim 94. In other embodiments, the axial stops 98 could extend axially from the trailing ends 104 of two of the ridges upwardly away from the annular rim 94 and toward the top of the container neck 12. In the preferred embodiment, the axial stops 98 extend from the trailing ends 104 of adjacent ridges 96, but in other embodiments they could extend from the trailing ends of ridges that are not adjacent each other.

The cap 10 may be attached to the container neck 12 by two methods. In the first method, the cap 10 and container neck 12 are positioned in desired relative positions with the cap and container neck axes aligned and with the cap interior surface just above the opening of the container neck. Where the cap is part of a trigger sprayer, the trigger sprayer and container are in their relative positions desired when the trigger sprayer is to be used in dispensing a product from the container. The cap 10 is then moved axially, downwardly on the container neck causing the lower lugs 68 to snap over the ridges 96. The tapered bottom surfaces 78 of the lower lugs 68 facilities their passage over the ridges 96. When the lower lugs 68 pass over the ridges 96 as the cap is pressed downwardly on the container neck, they snap into position against the container neck 12 and below the ridges 96 as shown in FIG. 4. In this position of the lower lugs 68 beneath the container neck ridges 96, the pairs of upper lugs 72 are in engagement with the top surfaces of the ridges 96. Also, the annular rim 94 on the container neck is in engagement with the cap interior surface 64 just below the lower lugs 68. The engagement of the annular rim 94 with the cap interior surface 64, the engagement of the lower lugs 68 beneath the container neck ridges 96, and the engagement of the upper lugs 72 with the container neck ridges 96 securely holds the cap 10 on the container neck 12 and prevents any relative movement or rocking of the cap on the container neck. According to this method, the cap can be attached to the container by the same mechanism currently being employed in production that positions a bayonet-type cap connector on a liquid container neck and then snap fits the bayonet-type connector on the container neck.

According to the second method of attaching the cap 10 on the container neck 12, the cap is rotated slightly relative to the container neck from the position it would occupy when a trigger sprayer that is part of the cap is used in dispensing a liquid product from the container. In this rotated position of the cap, the lower lugs 68 and their associated pairs of upper lugs 72 are positioned just above the arcuate spacings 106 between adjacent ridges 96 on the container neck. The cap is then moved downwardly onto the container neck with the lower lugs 68 passing through the arcuate spacings 106 between adjacent ridges 96. The cap is then rotated slightly relative to the container causing the ridges 96 on the container neck to pass between the lower lugs 68 and their associated pairs of upper lugs 72. The arched top surfaces 76 of the lower lugs 68 assists in the passage of the ridges 96 between the lower and upper lugs. The rotation is continued until two of the lower lugs 68 engage against the stops 98 of the container neck, thus preventing any further rotation of the cap on the container neck and completing the attachment of the cap on the container. Again, the engagement of the annular rim 94 against the cap interior surface 64, the engagement of the lower lugs 68 against the bottom surface of the annular ridges 96, and the engagement of the upper lugs 72 against the top surfaces of the ridges 96 securely holds the cap to the container and prevents any rocking movement of the cap on the container. With the cap 10 in its closed position on the container neck 12, the sealing collar 62 of the cap extends through the bottle neck opening 92 and into the interior of the neck. As best seen in FIG. 4, the cap sealing collar 62 has an exterior circumference dimensioned to fit tightly into the interior of the bottle neck 12, and thereby provide a seal of the bottle neck opening 92.

In the manufacturing of plastic bottles it is difficult to maintain a consistent distance between the top of the bottle neck and the shoulder 88 surrounding the bottom of the bottle neck. This dimension becomes particularly important in plastic bottles employing a bayonet-type connector on their neck. If the distance between the portion of the bayonet connector on the bottle neck and the top surface of the bottle neck becomes too large, the top of the bottle neck will engage against the underside of the cap top wall before the portion of the bayonet connector on the cap engages securely with the portion of the bayonet connector on the bottle neck. With the closure of the present invention, in order to prevent the distance between the ridges 96 and the top of the bottle neck 108 from becoming so large that the top of the bottle would engage the underside of the cap top wall 58 before the lower lugs 68 pass over and engage under the ridges 96, the bottle neck is made with a tolerance or is made short at its top so that there is a gap between the top of the bottle neck 108 and the inside surface 112 of the cap top wall 58.

The spacing between the top of the bottle neck 108 and the underside of the cap top wall 112 is made possible because the closure of the invention securely attaches the cap to the container neck without the need for the top of the neck 108 engaging with the underside 112 of the cap top wall. This is because the upper lugs 72 and the lower lugs 68 engage with opposite sides of the ridges 96 holding the ridges between them and securely holding the cap to the bottle neck. In prior art bayonet connectors it was necessary for the top of the bottle neck to engage against the underside of the cap top wall and the cap bayonet connector portion to engage underneath the bottle neck bayonet connector portion to securely hold the cap to the bottle, thus requiring a more expensive manufacturing process for producing the plastic bottle to ensure that the distance between the top of the bottle neck and the underside of the bayonet connector portion on the bottle neck was not too large.

Although there is a spacing between the top of the container neck 108 and the underside of the cap top wall 112, the connection between the cap 10 and container neck 12 is still sealed by the engagement of the annular sealing collar 62 inside the container neck 12. In alternate embodiments, the gap between the top of the container neck 108 and the underside 112 of the cap top wall accommodates a gasket used in place of the annular sealing collar 62. With a variation of the cap not employing the sealing collar 62, a conventional gasket is placed inside the cap and against the underside 112 of the top wall. When the cap is attached to the container neck the gasket is compressed between the top of the container neck 108 and the underside 112 of the cap top wall providing a seal between the cap and container neck.

The construction of the closure of the invention enables the cap and container to be modified with various types of locking devices such as those disclosed in U.S. patent applications Ser. Nos. 08/709,165 and 08/719,724, and (Howell & Haferkamp, L.C. Docket No. 976106) all of which are assigned to the assignee of the present invention and all of which are incorporated herein by reference.

The closure of the invention described above provides a closure for a cap and container, where the cap may be securely attached to the container by snap fitting the cap on the container or by turning the cap less than one-quarter of a turn relative to the container neck while providing a secure connection between the cap and container neck where the cap will not rock relative to the container.

While the present invention has been described by reference to a specific embodiment, it should be understood that modifications and variations of the invention may be constructed without departing from the scope of the invention defined in the following claims.

What is claimed:

1. A closure for a cap and container comprising:

a cap having a center axis and a cylindrical interior surface with a lower lug projecting radially inwardly from the interior surface and an upper lug projecting radially inwardly from the interior surface, the upper lug being axially spaced from the lower lug;

a container having an opening with a center axis and a cylindrical neck extending around the opening, a ridge extends radially outwardly from the container neck and the ridge is positioned on the neck where the lower lug will engage against a bottom of the ridge and the upper lug will engage against a top of the ridge when the cap is attached to the neck.

2. The closure of claim 1, wherein:

the lower lug is one of a plurality of lower lugs on the interior surface of the cap, the plurality of lower lugs are spaced arcuately from each other;

the upper lug is one of a plurality of upper lugs on the interior surface of the cap, the plurality of upper lugs are spaced arcuately from each other;

the ridge is one of a plurality of ridges on the container neck, the plurality of ridges are spaced arcuately from each other, and each ridge of the plurality of ridges is positioned on the container neck where at least one lower lug of the plurality of lower lugs will engage against the bottom of at least one ridge and at least one upper lug of the plurality of upper lugs will engage against the top of at least one ridge when the cap is attached to the neck.

3. The closure of claim 1, wherein:

the upper lug is one of a pair of upper lugs that project radially inwardly from the interior surface and are axially spaced from the lower lug.

4. The closure of claim 1, wherein:

the pair of upper lugs are spaced arcuately from each other and are positioned on opposite sides of the lower lug.

5. The closure of claim 1, wherein:

the container neck has a circumference and the ridge has an arcuate length that is less than half the container neck circumference.

6. The closure of claim 1, wherein:

the container neck has a circumference and the ridge has an arcuate length that is less than a quarter of the container neck circumference.

7. The closure of claim 2, wherein:

each of the plurality of ridges has an arcuate length and the arcuate lengths of the plurality of ridges are positioned in a single plane that is perpendicular to the center axis of the container neck.

8. The closure of claim 1, wherein:

the ridge has a leading end and a trailing end and an arcuate length therebetween, a stop extends radially outwardly from the container neck and axially over the container neck, and the stop is positioned on the container neck where the cap can be rotated on the container neck with the ridge passing between the upper lug and the lower lug of the cap until one of the upper lug and lower lug engages against the stop, thereby preventing further rotation of the cap on the container neck.

9. The closure of claim 8, wherein:

the stop is positioned on the container neck where the lower lug engages against the stop when the cap is rotated on the container neck, thereby preventing further rotation of the cap on the container neck.

10. The closure of claim 1, wherein:

a trigger sprayer housing is attached integrally with the cap preventing the cap from moving relative to the trigger sprayer housing.

11. The closure of claim 10, wherein:

the trigger sprayer housing and the cap have been molded monolithically together.

12. A closure for attaching a cap to a container neck surrounding an opening of the container, the container neck having a ridge projecting radially outwardly from the neck, the ridge having a leading end and a trailing end with an arcuate length therebetween, the closure comprising:

a cap having a center axis and a cylindrical interior surface with a lower lug projecting radially inwardly from the interior surface and an upper lug projecting radially inwardly from the interior surface with an axial spacing between the lower lug and upper lug dimensioned to receive the container neck ridge therebetween when attaching the cap to the container neck.

13. The closure of claim 12, wherein:

the lower lug is one of a plurality of lower lugs on the interior surface of the cap, the plurality of lower lugs are spaced arcuately from each other with the spacing between adjacent lower lugs being sufficiently large to enable the container neck ridge to pass axially between the adjacent lower lugs when attaching the cap to the container neck.

14. The closure of claim 12, wherein:

the upper lug is one of a pair of upper lugs that project radially inwardly from the interior surface and are axially spaced from the lower lug.

15. The closure of claim 12, wherein:

the pair of upper lugs are spaced arcuately from each other and are positioned on opposite sides of the lower lug.

16. The closure of claim 13, wherein:

the upper lug is one of a plurality of upper lugs arranged in a circle around the interior surface and the plurality of upper lugs are arcuately spaced from each other.

17. The closure of claim 13, wherein:

a trigger sprayer housing is attached integrally with the cap preventing the cap from moving relative to the trigger sprayer housing.

18. A closure for a container for receiving a cap thereon, the cap having a cylindrical interior surface with a lower lug projecting radially inwardly from the interior surface and an upper lug projecting radially inwardly from the interior surface with a spacing between the upper lug and the lower lug, the closure comprising:

a container having an opening with a center axis and a neck surrounding the opening, a plurality of arcuate ridges project radially outwardly from the neck and are arranged in a circle around the neck with a spacing between adjacent ridges, and each of the ridges has an axial width dimensioned to enable at least one of the ridges to pass between the lower lug and the upper lug of the cap when attaching the container neck to the cap.

19. The closure of claim 18, wherein:

the spacing between adjacent ridges is dimensioned to enable the lower lug of the cap to pass between adjacent ridges through the spacing when attaching the container neck to the cap.

20. The closure of claim 18, wherein:

each ridge has a leading end and a trailing end and an arcuate length therebetween, at least one stop extends radially outwardly from the container neck and axially over the container neck at the trailing end of one of the ridges where the cap can be rotated on the container neck with the one ridge passing between the upper lug and the lower lug of the cap until one of the upper lug and lower lug engages against the stop, thereby preventing further rotation of the cap on the container neck.

* * * * *